US007353970B1

(12) United States Patent
Harrison-Coats

(10) Patent No.: US 7,353,970 B1
(45) Date of Patent: Apr. 8, 2008

(54) FOOD AND BEVERAGE ARTICLE DISPENSER

(76) Inventor: Daneen Y. Harrison-Coats, 2359 Echo Valley Dr., Stow, OH (US) 44224

( * ) Notice: Subject to any disclaimer, the term of this patent is extended or adjusted under 35 U.S.C. 154(b) by 241 days.

(21) Appl. No.: 11/248,364

(22) Filed: Oct. 12, 2005

Related U.S. Application Data

(60) Provisional application No. 60/617,844, filed on Oct. 13, 2004.

(51) Int. Cl.
*B65G 59/00* (2006.01)

(52) U.S. Cl. ..... 221/279; 221/283; 221/123

(58) Field of Classification Search ..... 221/279
See application file for complete search history.

(56) References Cited

U.S. PATENT DOCUMENTS 1,564,529 A * 12/1925 Carter ..... 312/43
3,512,826 A * 5/1970 Hahn ..... 296/22
3,788,487 A * 1/1974 Dawson ..... 221/45
3,930,698 A 1/1976 Colgan
4,033,478 A 7/1977 House
4,243,153 A * 1/1981 Mitchell ..... 221/34
D279,521 S * 7/1985 Zucker ..... D3/316
D307,842 S 5/1990 Bieganski
4,957,206 A * 9/1990 Banko et al. ..... 211/40
5,074,431 A 12/1991 Sendelbach
5,203,531 A 4/1993 Gracon
5,255,818 A 10/1993 Zeigler
5,502,848 A 4/1996 Cowan
5,806,944 A * 9/1998 Greenfield ..... 312/244
6,886,702 B2 * 5/2005 Trinidad et al. ..... 211/181.1

* cited by examiner

*Primary Examiner*—Gene O. Crawford
*Assistant Examiner*—Timothy R Waggoner
(74) *Attorney, Agent, or Firm*—John D. Gugliotta; Mandy Seuffert

(57) ABSTRACT

A food and beverage article dispenser is provided which is adapted to be surface mounted. The apparatus is adapted to dispense disposable or nondisposable cups and plates. The apparatus includes a paper towel roll holder, a storage drawer, and a fold-away utensil organizer.

20 Claims, 8 Drawing Sheets

FOOD AND BEVERAGE ARTICLE DISPENSER

RELATED APPLICATIONS

This application claims the benefit of U.S. Provisional Application No. 60/617,844 filed on Oct. 13, 2004.

BACKGROUND OF THE INVENTION

1. Field of the Invention

The present invention relates generally to dispensers for plates and, more particularly, to a food and beverage article dispenser adapted to be surface mounted.

2. Description of the Related Art

The prior art discloses many self-service devices for dispensing stackable food and beverage articles, such as plate dispensers, cup dispensers, paper cup stack holders, and bowl dispensers. However, such devices are not only awkward to use, but they are also susceptible to deformation, thus weakening the articles. In addition, many of these devices presented food and beverage articles for removal at a lower end of a container in which they were stacked for dispensing, and relied on gravity feed for positioning the next successive cup to be dispensed into withdrawal position. Further, the aforementioned devices have all failed to disclose a food and beverage article dispenser incorporating a compartment for storing various disposable or nondisposable tableware articles such as plates, cups, plate/cup lids, towellets, and napkins, a collapsible paper towel holder, and a pivoting flatware organizer.

Accordingly, a need has arisen for a lightweight, rigid, multi-functional food and beverage article dispenser adapted for organizing and dispensing disposable or nondisposable food and beverage articles, and which is further adapted to be mounted to a surface such as a wall in a manner which is quick, easy, and efficient. The development of the food and beverage article dispenser fulfills this need.

A search of the prior art did not disclose any patents that read directly on the claims of the instant invention; however, the following references were considered related.

The following patents disclose devices for dispensing and holding plates:

U.S. Pat. No. 5,074,431, issued in the name of Sendelbach;

U.S. Pat. No. 3,930,698, issued in the name of Colgan; and

U.S. Pat. No. 5,255,818, issued in the name of Zeigler.

U.S. Pat. No. 4,033,478, issued in the name of House discloses a cup dispenser that presents cups from below for dispensing at the top of the container in which they are stacked.

U.S. Pat. No. Des. 307,842, issued in the name of Bieganski discloses the ornamental design for a paper cup dispenser.

U.S. Pat. No. 5,203,531, issued in the name of Gracon discloses a paper cup stack holder comprised of a conical base unit and a plurality of adjustable prongs adapted to snugly accommodate cups of different sizes.

U.S. Pat. No. 5,502,848, issued in the name of Cowan discloses a portable wash basin stand for use outdoors.

Consequently, a need has arisen for a lightweight, rigid, multi-functional food and beverage article dispenser adapted for organizing and dispensing disposable or nondisposable food and beverage articles, and which is further adapted to be mounted to a surface such as a wall in a manner which is quick, easy, and efficient.

SUMMARY OF THE INVENTION

Therefore, it is an object of the present invention to provide a food and beverage article dispenser adapted to be surface mounted.

It is another object of the present invention to provide a food and beverage article dispenser fabricated of a lightweight, rigid material.

It is another object of the present invention to provide a food and beverage article dispenser adapted to functionally accommodate and dispense disposable or nondisposable cups and plates.

It is another object of the present invention to provide a food and beverage article dispenser having a paper towel roll holder.

It is yet another object of the present invention to provide a food and beverage article dispenser having a storage drawer for storing plate and cup lids, wet towellettes, and the like.

It is still another object of the present invention to provide a collapsible handle to facilitate easy transport of the device.

It is another object of the present invention to provide a fold-away utensil organizer.

It is another object of the present invention to provide a food and beverage article dispenser which may be individually adorned with distinctive ornamentation, decorative patterns, colors, indicia, phrases, markings, or symbols so as to represent a particular theme.

Briefly described according to one embodiment of the present invention, a food and beverage article dispenser adapted to be surface mounted is provided. The food and beverage article dispenser, hereinafter dispenser, comprises a lightweight housing having a hollow interior. The housing is fabricated of a lightweight, rigid material, preferably plastic or plastic polymer, although other suitable materials including but not limited to wood and lightweight metal may be employed. The housing defines a generally square configuration and includes a top wall molded integral to an upstanding sidewall, wherein upstanding sidewall extends vertically downward from top wall about an entire periphery thereof, and wherein upstanding sidewall is molded integral to a bottom wall.

A front edge of both the top wall and bottom wall defines two narrow lobe portions having a longitudinal configuration which flank a wide, middle portion. A pair of inwardly-collapsible, paper towel roll holders are mounted in spaced relation to the middle portion.

The upstanding sidewall further defines a left sidewall having an elongated opening defined between a pair of integrally-formed, opposing, inner sidewalls. The opposing, inner sidewalls are perpendicularly-oriented with respect to left sidewall. The opening provides entry into a drawer receiving cavity which is adapted to slidably receive a storage drawer via a track assembly.

A handle is mounted to the storage drawer to facilitate ease in opening and closing thereof.

The upstanding sidewall still further defines a right sidewall having a recessed, middle portion to which a utensil organizer is hingedly attached via a bracket assembly. The utensil organizer is adapted to fold outwardly away from a second upstanding sidewall to an inclined position at which utensil organizer is held thereat or prevented from further inclination via bracket assembly. After use, utensil organizer is folded upward toward second upstanding sidewall, against which organizer is fastened via a friction-fit fastening means. The utensil organizer is provided with a plurality of individual compartments for storing selected utensils, and a retaining net is affixed atop compartments in order to retain utensils therein. A handle is mounted to an outer sidewall of organizer.

In order to facilitate manual dispensing of cups, one at a time, the housing defines a cup dispenser assembly which includes a plurality of cylindrical, longitudinally-extending containers formed integral to the top wall and extending vertically downward therefrom so as to reside within hollow interior of housing. The containers are molded integral and positioned along at least three corners of the top wall of housing. The containers each define a closed bottom end. Each container further defines an open, upper end with an annular flange affixed thereto, wherein flange extends into an elongated, tubular member peripherally affixed against an internal circumferential sidewall of container.

A circular pressure head is provided which is slidably disposed within tubular member of each container. The circular pressure head includes a downwardly-depending apron extending peripherally thereabout. The circular pressure head is resiliently biased in an upward direction of tubular member by a helical compression spring coupled between an underside of circular pressure head and the closed bottom end of container.

In order to facilitate manual withdrawing, one at a time, of stacked cups, a plurality of leaf springs are mounted inwardly through a respective slot of tubular member below annular flange at a first end of leaf spring, and downward through an opening formed between tubular member and container at a second end of leaf spring.

The cups are supported atop circular pressure head in an inverted manner, wherein the protuberant lip of the uppermost protruding cup rests in biased engagement against the arcuate portion of leaf spring. As the cup is withdrawn, the arcuate portion of leaf spring flexes slightly inward to a degree allowing passage of cup beyond the spring, while spring maintains sufficient biased engagement against remaining cups, thus maintaining such cups in stacked arrangement.

In order to facilitate dispensing of plates, the housing further defines a plate dispenser assembly which includes a cylindrical, longitudinally-extending receptacle formed integral to the top wall, positioned generally central thereabout, and extending vertically downward therefrom so as to reside within hollow interior of housing. The receptacle further defines an open, upper end opposing a closed bottom end. The receptacle is of a similar design and configuration as container, except having a larger diameter, the measure of which being sufficient to accommodate standard-sized, commercially-available disposable or nondisposable plates.

The receptacle includes a circular pressure head being slidably disposed therein. The circular pressure head includes a downwardly-depending apron extending peripherally thereabout. The circular pressure head is spring-urged in an upward direction of receptacle by a spring, such as a helical compression spring coupled between an underside of circular pressure head and the closed bottom end of receptacle. Spring is a resilient type adapted to compress when a stack of plates are supported atop circular pressure head and to resiliently bias pressure head upwardly as each plate is successively withdrawn.

In order to mount the present invention to a surface such as a wall, a pair of surface-mounting brackets are integrally molded to a rear upstanding sidewall of housing in spaced relation. Each surface-mounting bracket is provided with at least one aperture through which a fastener, such as a bolt, is inserted and screwed into the wall.

A collapsible handle is horizontally mounted to rear upstanding sidewall between the pair of surface-mounting brackets.

It is envisioned that the top wall is adorned with an ornamental logo.

It is further envisioned that the food and beverage article dispenser may be individually adorned with distinctive ornamentation, decorative patterns, colors, indicia, phrases, markings, or symbols so as to represent a particular theme.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENT

1. Detailed Description of the Figures

Figure 1:
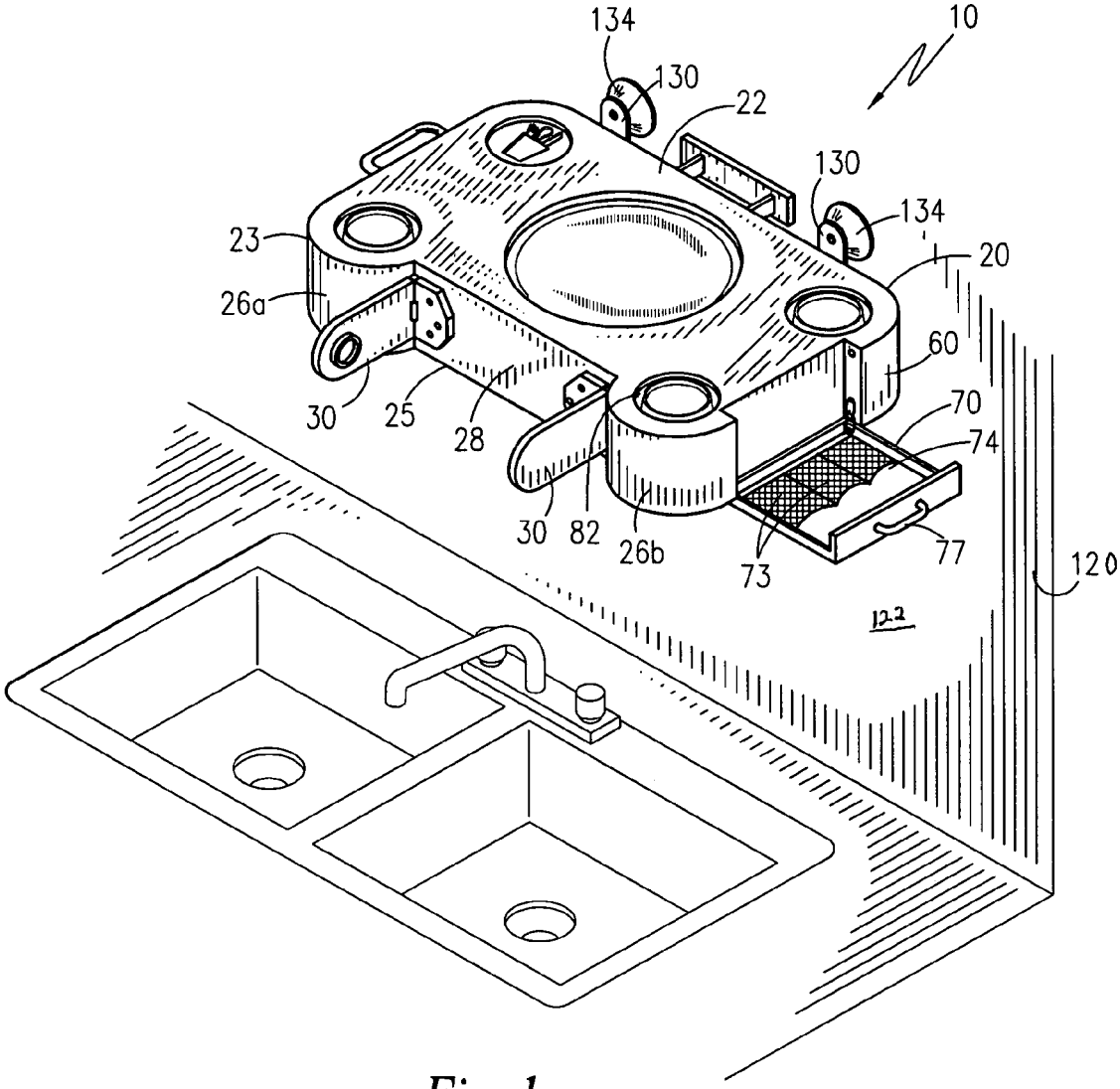
FIG. 1 is a perspective view of a food and beverage article dispenser shown mounted to a surface, according to the preferred embodiment of the present invention.

Referring now to FIGS. 1-6, a food and beverage article dispenser 10 is shown, according to the present invention, comprised of a housing 20 adapted to be surface mounted. The housing is lightweight and has a hollow interior. The housing is fabricated of a lightweight, rigid material, preferably plastic or plastic polymer, although other suitable materials including but not limited to wood and lightweight metal may be employed. The housing 20 defines a generally square configuration and includes a top wall 22 molded integral to an upstanding sidewall 23, wherein upstanding sidewall 23 extends vertically downward from top wall 22 about an entire periphery thereof, and wherein upstanding sidewall 23 is molded integral to a bottom wall 25.

A front edge of both the top wall 22 and bottom wall defines two narrow lobe portions 26*a* and 26*b* having a longitudinal configuration which flank a wide, middle portion 28. A pair of inwardly-collapsible, paper towel roll holders 30 are mounted in spaced relation to the middle portion 28. Holders 30 are adapted to support a standard commercially-available paper towel roll 31.

The upstanding sidewall 23 further defines a left sidewall 23*a* having an elongated opening 33 defined between a pair of integrally-formed, opposing, inner sidewalls 29. The opposing, inner sidewalls 29 are perpendicularly-oriented with respect to left sidewall 23*a*. The opening 33 provides entry into a drawer receiving cavity 34 which is adapted to slidably receive a storage drawer 40 via a track assembly 50 (to be described later in greater detail). The storage drawer 40 defines an arcuate-shaped, front wall 42 opposing a horizontally-oriented rear wall 44, and two opposing vertically-oriented sidewalls 46. The front wall 42 is envisioned to be transparent. The storage drawer 40 further defines a bottom wall 47 opposing an open top 48 which provides entry into an article storage cavity 49. The article storage cavity 49 may be used for storing plate and cup lids, wet towellettes and the like (not shown).

Figure 4:
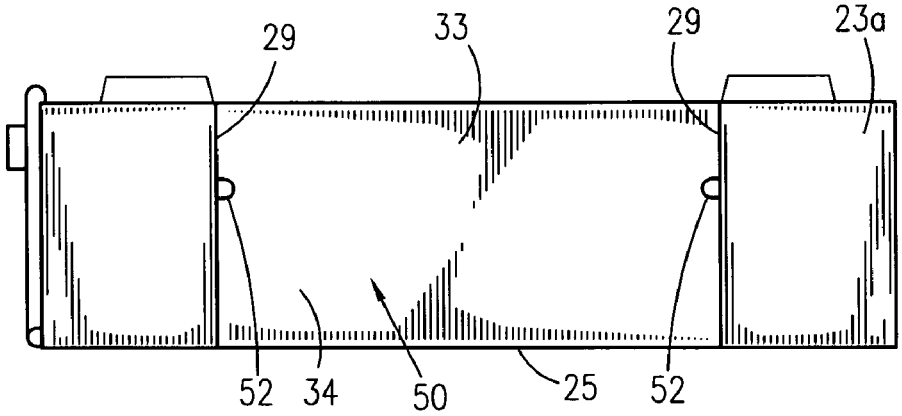
FIG. 4 is a left side elevational view of the present invention illustrating the track assembly, according to the preferred embodiment.
Figure 5:
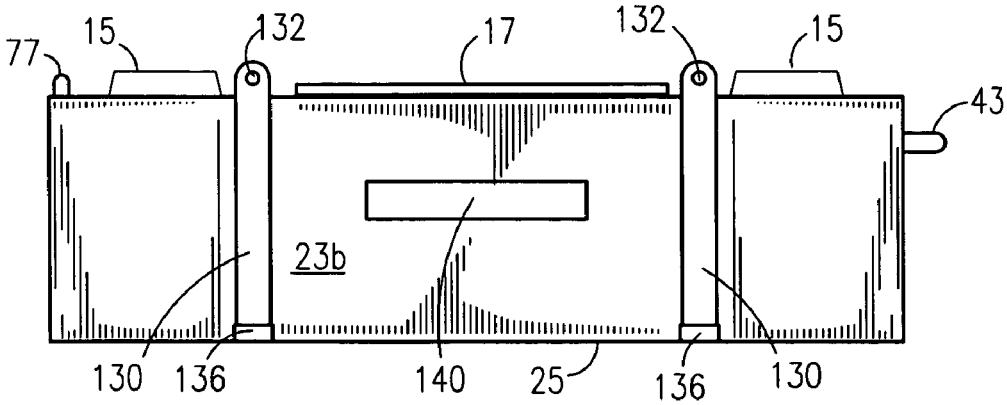
FIG. 5 is a rear side elevational view of the present invention illustrating the surface-mounting brackets, according to the preferred embodiment.
Figure 6:
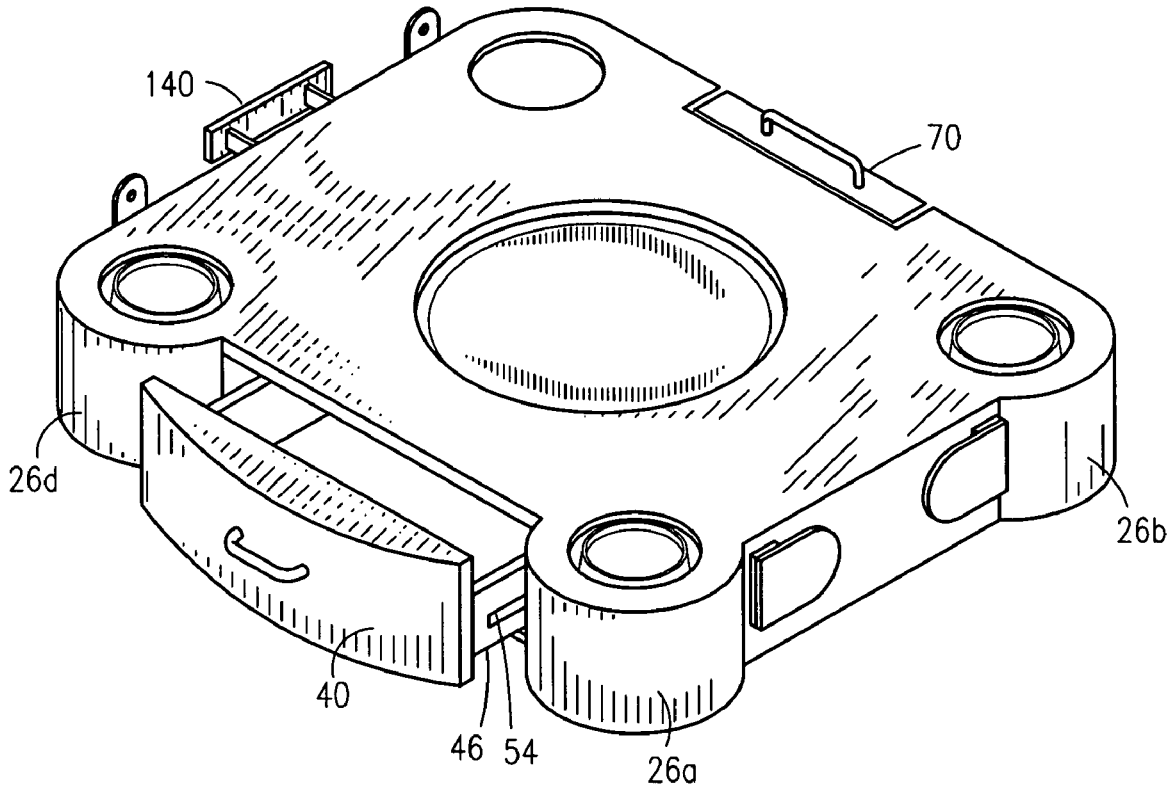
FIG. 6 is a perspective view of the present invention illustrating the storage drawer, according to the preferred embodiment of the present invention.
Figure 7:
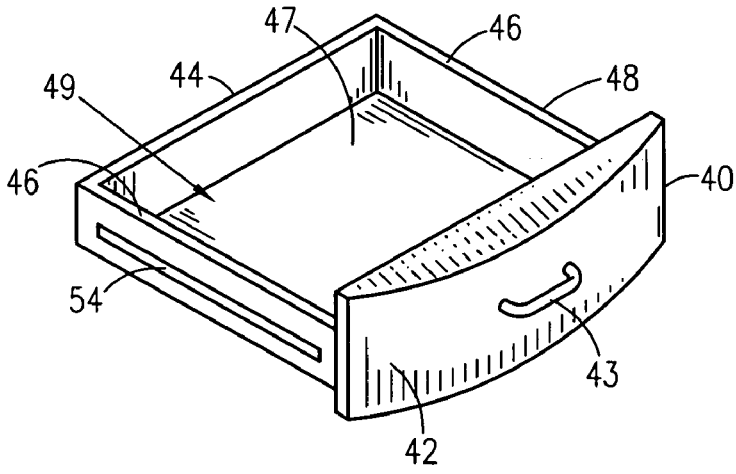
FIG. 7 is a perspective view of the storage drawer illustrating an elongated channel thereof, according to the preferred embodiment of the present invention.
Figure 8:
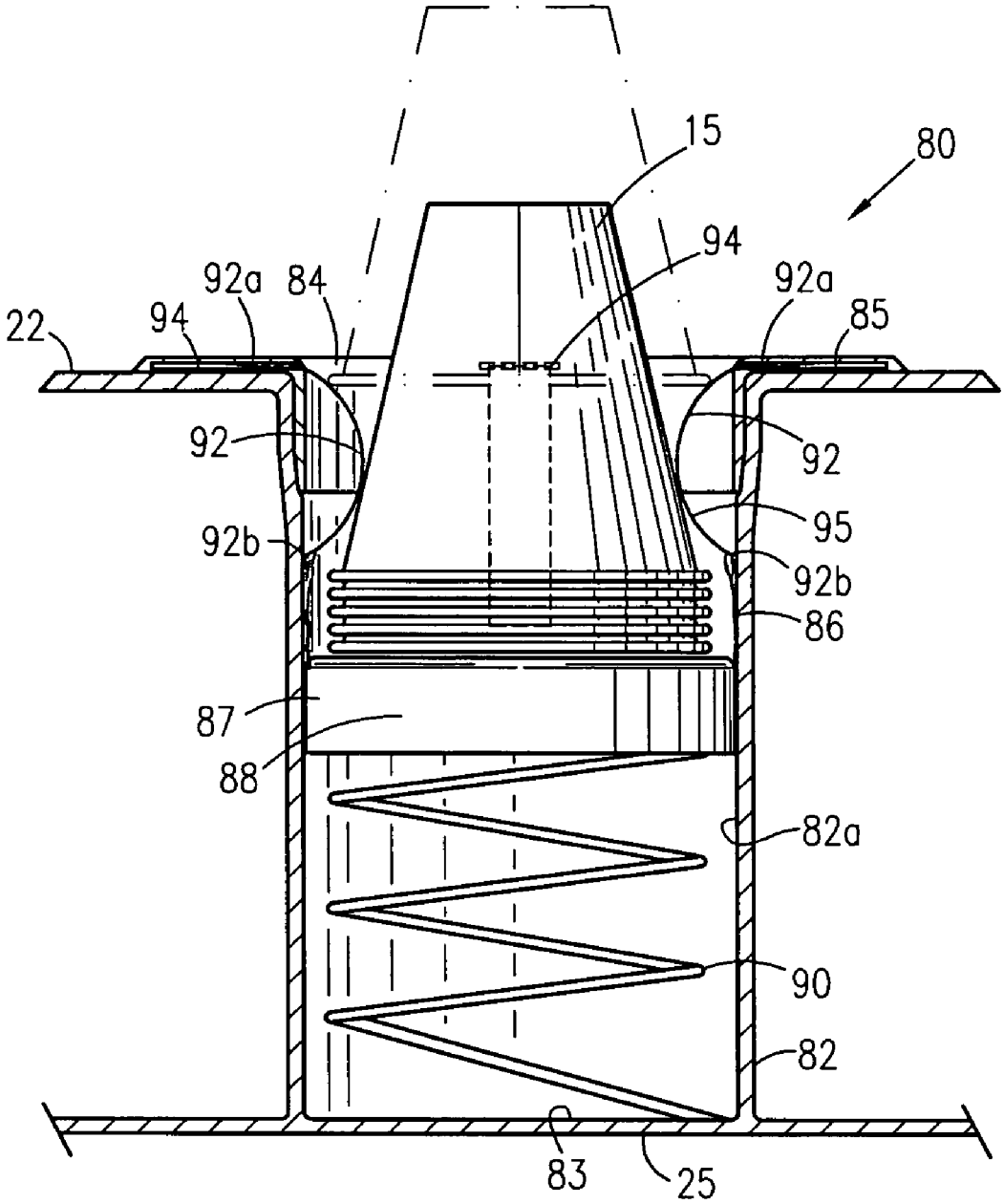
FIG. 8 is a cross-sectional view of the cup dispenser assembly, according to the preferred embodiment of the present invention.

Referring more specifically to FIGS. 4, 6, and 7, the track assembly 50 comprises a ridge segment 52 being integrally-formed and extending longitudinally down each of the opposing, inner sidewalls 29. Each ridge segment 52 is adapted to mate respectively with an elongated channel 54 formed in each vertically-oriented sidewall 46 of storage drawer 40.

The front wall 42 of storage drawer 40 is flanked by integral narrow lobe portions 26*a* and 26*d* having a longitudinal configuration so as to correspond aesthetically with the lobe portion 26*b* at the front edge of the top wall 22 and bottom wall 25.

A handle 43 is mounted to the front wall 42 of storage drawer 40 to facilitate ease in opening and closing thereof.

Referring now to FIGS. 1-3 and 5-6, the upstanding sidewall 23 still further defines a right sidewall 60 having a recessed, middle portion 62 to which a utensil organizer 70 is hingedly attached via a bracket assembly 75. The middle portion 62 is flanked by integral narrow lobe portions 26*b* and 26*c* having a longitudinal configuration so as to aesthetically correspond with lobe portion 26*a* at the front edge of the top wall 22 and bottom wall 25. The utensil organizer 70 is adapted to fold outwardly away from right sidewall 60 to an inclined position at which utensil organizer 70 is held thereat or prevented from further inclination via bracket assembly 75. After use, utensil organizer 70 is folded upward toward right sidewall 60, against which organizer 70 is detachably fastened via a friction-fit fastening means 72. The utensil organizer 70 is provided with a plurality of individual compartments 73 for storing selected utensils, and a retaining net 74 is affixed atop compartments 73 in order to retain utensils therein. A handle 77 is mounted to an outer sidewall 78 of organizer 70.

An alternate embodiment of the present invention is envisioned wherein utensil organizer 70 is detachably attached to middle portion 62 of right sidewall 60 of upstanding sidewall 23 via snap-fit, friction fit, hook and loop fastener or similar means, thereby allowing utensil organizer 70 to be temporarily separated or removed from housing 20 and subsequently detachably replaced after use.

Figure 2:
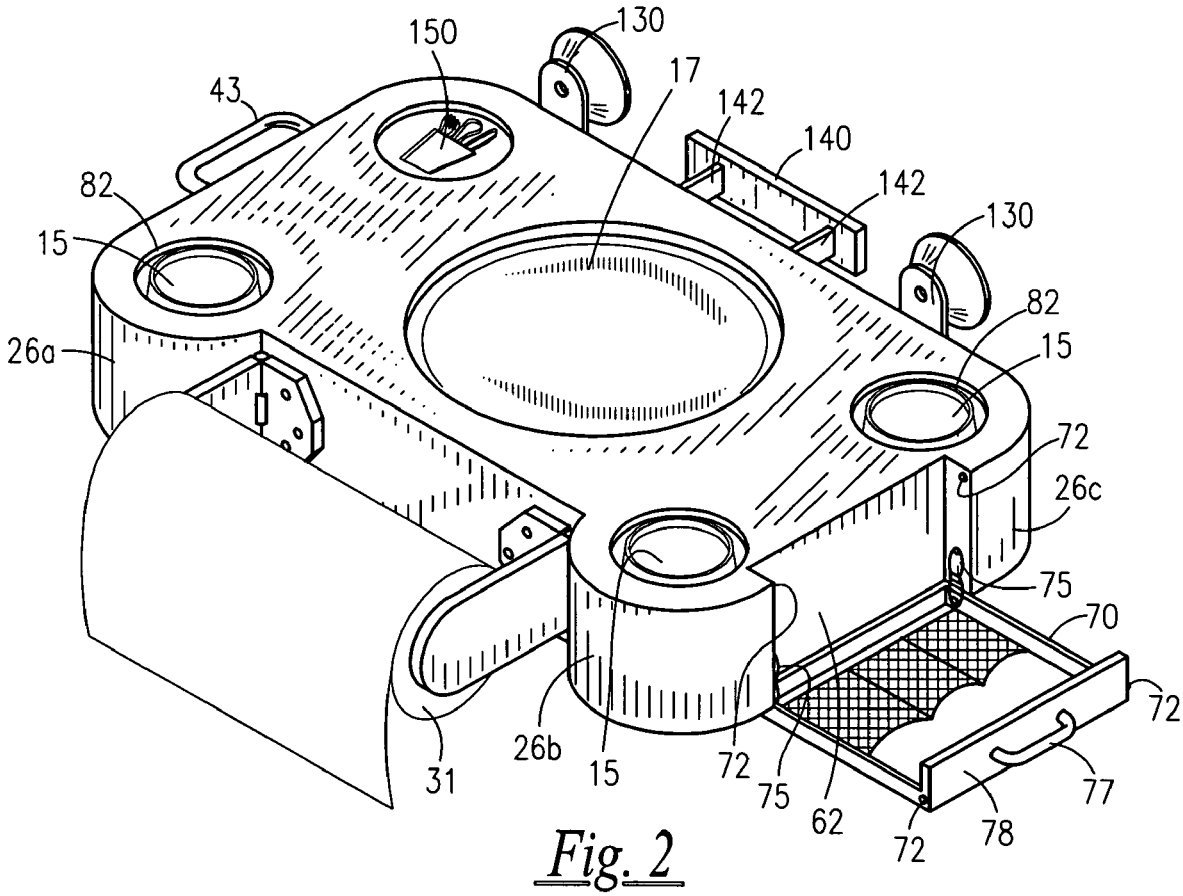
FIG. 2 illustrates another perspective view thereof.
Figure 3:
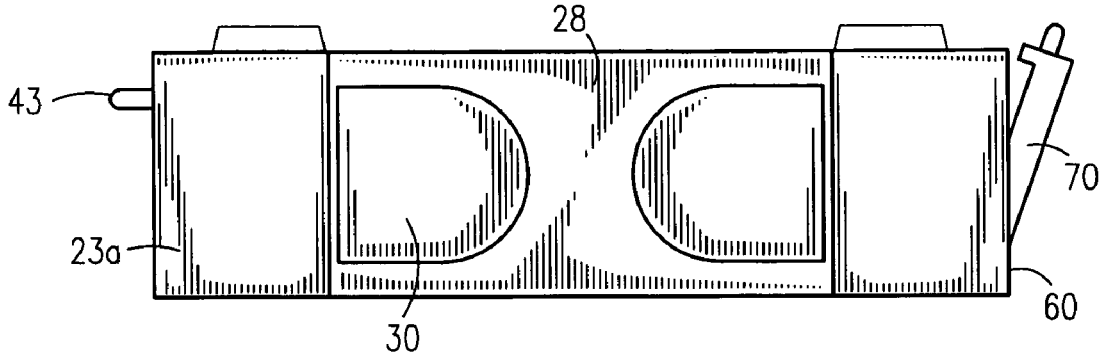
FIG. 3 is a front side view thereof.

Referring to FIGS. 1, 2, and 3, in order to facilitate manual dispensing of cups 15, one at a time, the housing 20 defines a cup dispenser assembly 80 which includes a plurality of cylindrical, longitudinally-extending containers 82 formed integral to the top wall 22 and extending vertically downward therefrom so as to reside within hollow interior of housing 20. The containers 82 are molded integral and positioned along at least three corners of the top wall 22 of housing 20. The containers 82 each define a closed bottom end 83. Each container 82 further defines an open, upper end 84 with an annular flange 85 affixed thereto, wherein flange 85 extends into an elongated, tubular member 86 peripherally affixed against an internal circumferential sidewall 82*a* of container 82.

A circular pressure head 87 is provided which is slidably disposed within tubular member 86 of each container 82. The circular pressure head 87 includes a downwardly-depending apron 88 extending peripherally thereabout. The circular pressure head 87 is resiliently biased in an upward direction of tubular member 86 by a helical compression spring 90 coupled between an underside of circular pressure head 87 and the closed bottom end 83 of container 82.

In order to facilitate manual withdrawing, one at a time, of stacked cups 15, a plurality of leaf springs 92 are mounted inwardly through a respective slot 94 of tubular member 86 below annular flange 85 at a first end 92*a* of leaf spring 92, and downward through an opening formed between tubular member 86 and container 82 at a second end 92*b* of leaf spring 92.

The cups 15 are supported atop circular pressure head 87 in an inverted manner, wherein the protuberant lip of the uppermost protruding cup 15 rests in biased engagement against the arcuate portion 95 of leaf spring 92. As the cup is withdrawn, the arcuate portion 95 of leaf spring 92 flexes slightly inward to a degree allowing passage of cup 15 beyond the spring 92, while spring 92 maintains sufficient biased engagement against remaining cups 15, thus maintaining such cups 15 in stacked arrangement. The cup dispenser assembly 80 is adapted to functionally accommodate disposable or nondisposable cups 15.

Figure 9:
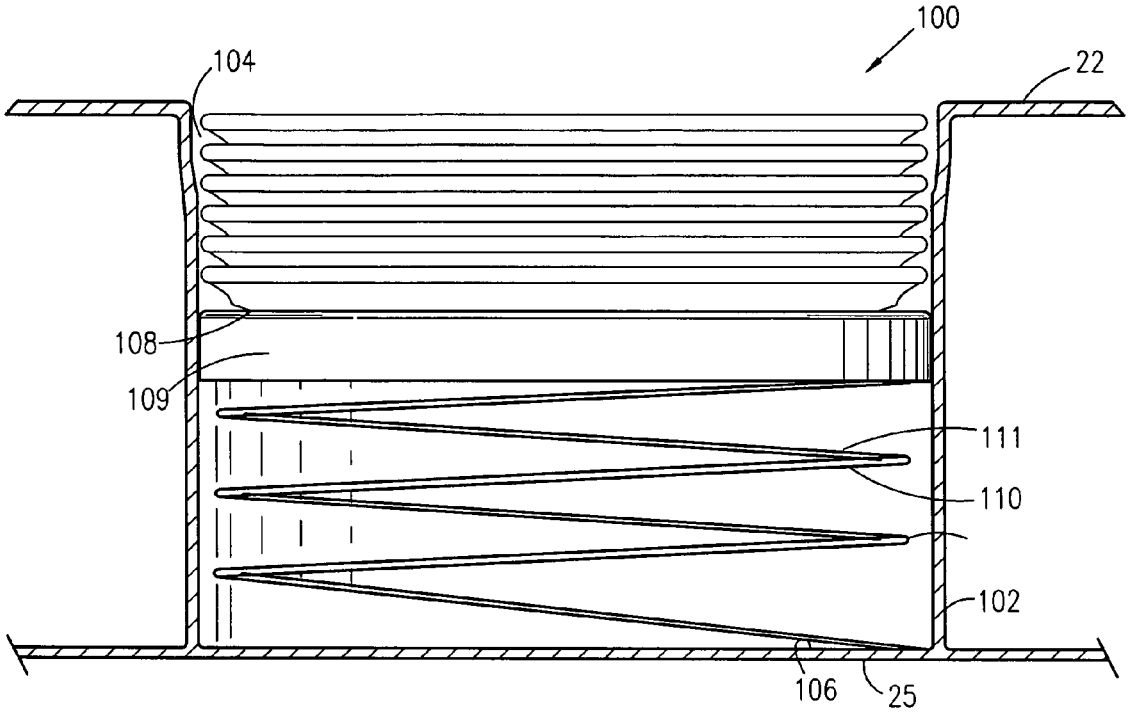
FIG. 9 is a cross-sectional view of the plate dispenser assembly, according to the preferred embodiment of the present invention.

Referring now more specifically to FIGS. 1, 2, and 9, in order to facilitate dispensing of plates 17, the housing 20 further defines a plate dispenser assembly 100 which includes a cylindrical, longitudinally-extending receptacle 102 formed integral to the top wall 22, positioned generally central thereabout, and extending vertically downward therefrom so as to reside within hollow interior of housing 20. The receptacle 102 further defines an open, upper end 104 opposing a closed bottom end 106. The receptacle 102 is of a similar design and configuration as container 82, except having a larger diameter, the measure of which being sufficient to accommodate standard-sized, commercially-available disposable or nondisposable plates 17.

The receptacle 102 includes a circular pressure head 108 being slidably disposed therein. The circular pressure head 108 includes a downwardly-depending apron 109 extending peripherally thereabout. The circular pressure head 108 is spring-urged in an upward direction of receptacle 102 by a spring 110, such as a helical compression spring 111 coupled between an underside of circular pressure head 108 and the closed bottom end 106 of receptacle 102. Spring 110 is defined as resilient and adapted to compress when a stack of plates 17 are supported atop circular pressure head 108 and to resiliently bias pressure head 108 upwardly as each plate 17 is successively withdrawn. The plate dispenser assembly 100 is adapted to functionally accommodate disposable or nondisposable plates 17.

Referring to FIGS. 1, 2, 5, and 6, in order to mount the present invention to a surface 120 such as a wall 122, a pair of surface-mounting brackets 130 are integrally molded to a rear upstanding sidewall 23*b* of housing 20 in spaced relation. Each surface-mounting bracket 130 is provided with at least one aperture 132 through which a fastener 134, such as a bolt, is inserted and screwed into the surface 120. The selected fastener 134 is of a type adapted for use with the particular surface 120 chosen for securely mounting the present invention to a wall 122. A lower end of each surface-mounting bracket 130 includes a pliable abutment member 136 being outwardly disposed therefrom.

A collapsible handle 140 is horizontally mounted to rear upstanding sidewall 23*b* between the pair of surface-mounting brackets 130. The collapsible handle 140 includes two elongated legs 142 adapted to retract within hollow interior of housing 20.

It is envisioned that the top wall 22 is adorned with an ornamental logo 150.

Figure 12:
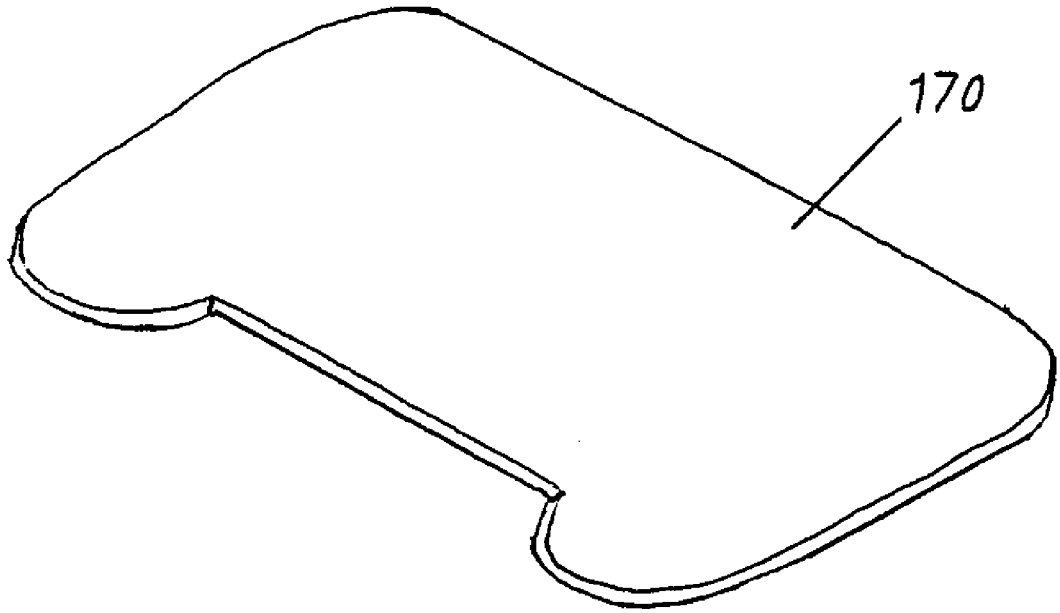
FIG. 12 is a perspective view of the dispenser cover.

It is further envisioned that a dispenser cover 170 (shown in FIG. 12) is superimposed over top wall 22 of housing 20 to protect top wall 22 and stored articles against dirt, debris, dust, and the like during transport or during periods of nonuse. The dispenser cover 170 defines a shape which closely corresponds to or matches a shape defining top wall 22 of housing 20.

Figure 10:
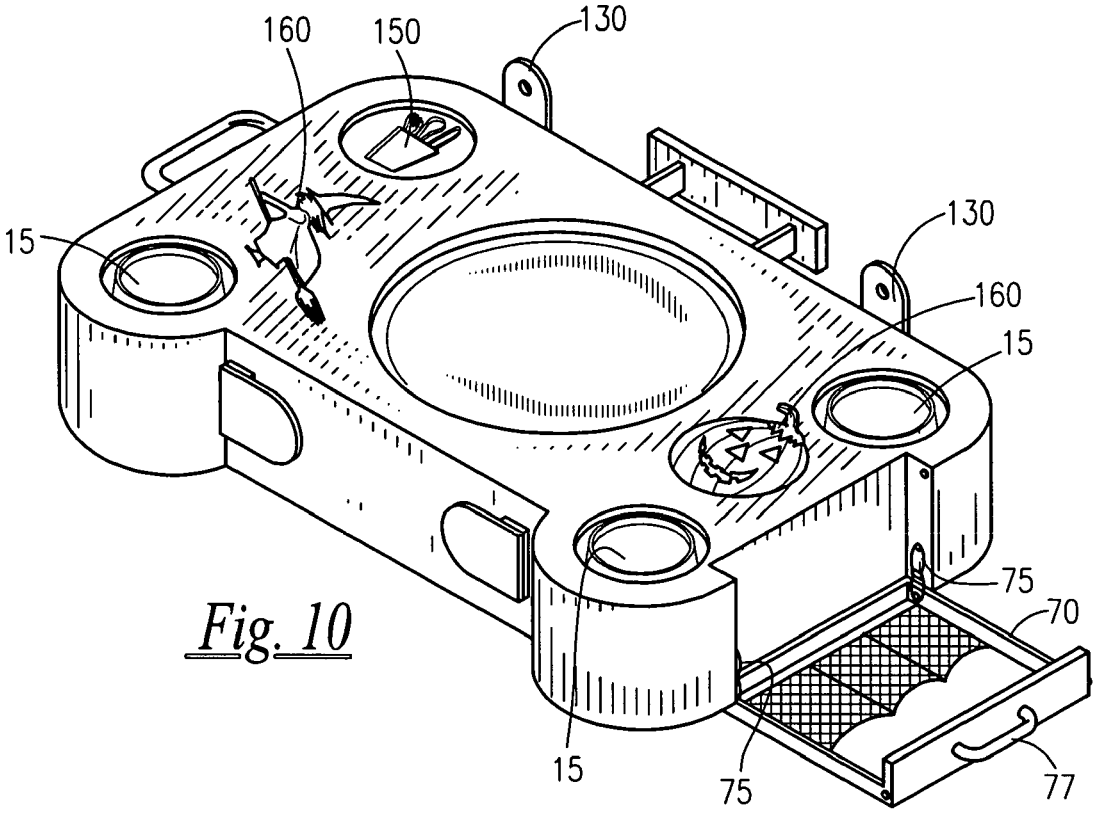
FIGS. 10-11 illustrate the present invention shown individually adorned with distinctive ornamentation.
Figure 11:
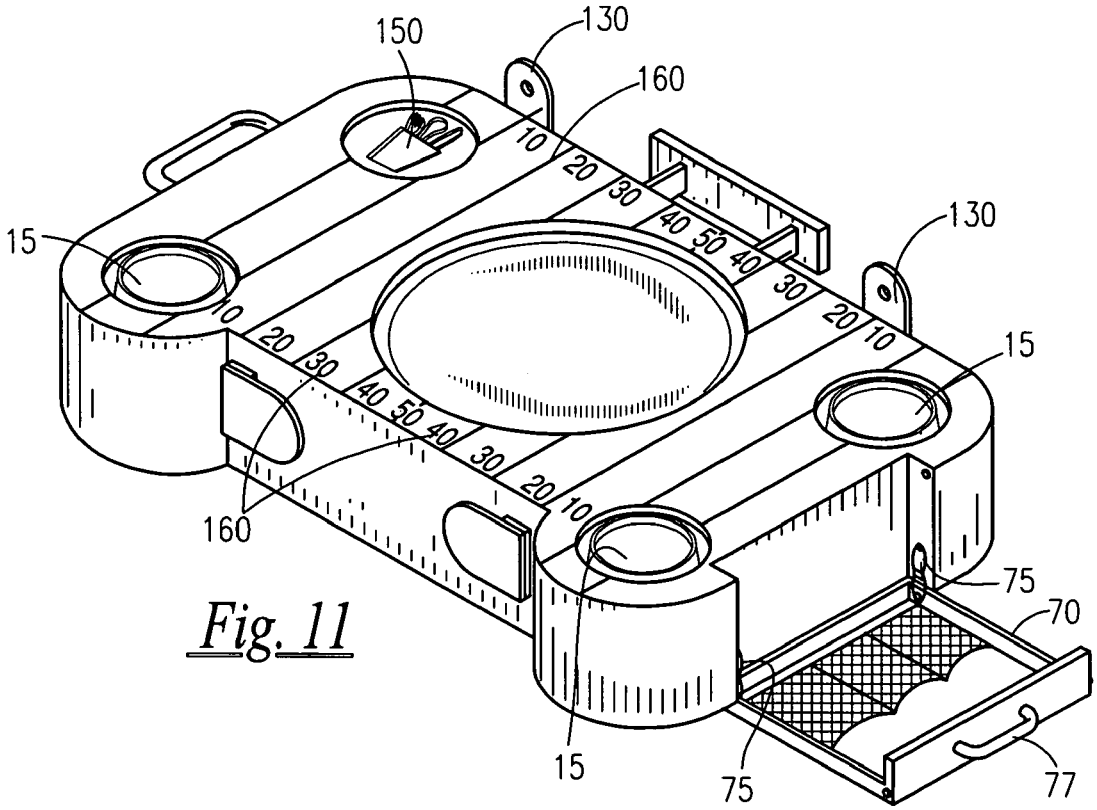

Referring now to FIGS. 10 and 11, examples are provided herein in order to illustrate that the top wall 22 and upstanding sidewall 23 of each food and beverage article dispenser 10 may be individually adorned with distinctive ornamentation 160, decorative patterns, colors, indicia, phrases, markings, or symbols so as to represent a particular theme, wherein theme is broadly construed to comprise holidays and symbols therefor, sports and sports symbols therefor, sports equipment and teams, personal names, wild life and exotic animals, domestic animals, aquatic life, cartoon characters, and decorative patterns including but not limited to camouflage, tie-dye, clouds, waves, gingham, plaid, fruits, polka dots, flowers, stars and stripes, and pin stripes.

Finally, it is recognized and intended that the food and beverage article dispenser 10 is also adapted for use in recreational vehicles, commonly referred to as RV's in addition to placement below removable cushions in vehicles such as SUVs, Pick-Up King Cab trucks, mini-vans, and conversion vans.

2. Operation of the Preferred Embodiment

To use the present invention, user mounts the food and beverage article dispenser 10 to a surface 120 via the surface-mounting bracket 130 using a fastener 134. User then loads plates 17 atop pressure head 108 within the receptacle 102 and loads cups 15 atop pressure head 87 within container 82. User next fills the storage drawer 40 with articles including cup lids and wet towellettes. User then opens the utensil organizer 70 and fills the plurality of individual compartments 73 thereof with desired utensils. User next attaches a paper towel roll 31 to paper towel roll holders 30. Finally, user dispenses cups 15, plates 17, and other food and beverage articles from the present invention as desired.

The use of the present invention provides the user with a quick, easy, and efficient means of Therefore, the foregoing description is included to illustrate the operation of the preferred embodiment and is not meant to limit the scope of the invention. As one can envision, an individual skilled in the relevant art, in conjunction with the present teachings, would be capable of incorporating many minor modifications that are anticipated within this disclosure. The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the Claims appended hereto and their equivalents. Therefore, the scope of the invention is to be broadly limited only by the following Claims.

What is claimed is:

1. A food and beverage article dispenser comprising:

a housing, said housing has a hollow interior, said housing is fabricated of a lightweight, rigid material and is adapted to be surface mounted, wherein said housing includes a top wall molded integral to an upstanding sidewall, wherein said upstanding sidewall extends vertically downward from said top wall about an entire periphery thereof, said upstanding sidewall is molded integral to a bottom wall, a cup dispenser assembly, said cup dispenser assembly is formed integral to said housing; and a plate dispenser assembly, said plate dispenser assembly is formed integral to said housing.

2. The food and beverage article dispenser of claim 1, wherein said cup dispenser assembly comprises a plurality of cylindrical, longitudinally-extending containers formed integral to said top wall, said containers extend vertically downward from said top wall so as to reside within said hollow interior of said housing, said containers are molded integral to and positioned along at least three comers of said top wall of said housing, said containers each define a closed bottom end, and wherein said containers each define an open, upper end with an annular flange affixed thereto, said annular flange extends into an elongated, tubular member being peripherally affixed against an internal circumferential sidewall of each said containers.

3. The food and beverage article dispenser of claim 2, wherein said tubular member includes a circular pressure head slidably disposed therein, said circular pressure head includes a downwardly-depending apron extending peripherally thereabout, an wherein said circular pressure head is resiliently biased in an upward direction of said tubular member by a compression spring, said compression spring is coupled between an underside of said circular pressure head and said closed bottom end of each said containers.

4. The food and beverage article dispenser of claim 2, wherein said cup dispenser assembly further comprises a plurality of leaf springs, wherein each leaf spring of said plurality of leaf springs is mounted inwardly through a respective slot defined through each said tubular member below said annular flange at a first end of said leaf spring, and downward through an opening formed between each said tubular member and each of said containers at a second end of said leaf spring.

5. The food and beverage article dispenser of claim 3, wherein said circular pressure head is adapted to support an inverted stack of cups thereatop.

6. The food and beverage article dispenser of claim 4, wherein said plurality of leaf springs each include an arcuate portion which rests in biased engagement against a protuberant lip of an uppermost protruding cup, said arcuate portion flexes slightly inward to a degree allowing passage of a single cup or the uppermost protruding cup beyond said leaf spring upon manual withdrawal of the uppermost protruding cup, while said leaf spring maintains sufficient biased engagement against remaining cups of the inverted stack of cups, thus maintaining the remaining cups in stacked arrangement, and thereby facilitating manual withdrawal of one cup at a time of the inverted stack of cups, said cup dispenser assembly is adapted to functionally accommodate and dispense disposable or nondisposable cups.

7. The food and beverage article dispenser of claim 1, wherein said plate dispenser assembly comprises a cylindrical, longitudinally-extending receptacle formed integral to said top wall, said receptacle is positioned generally central about said top wall, said receptacle extends vertically downward from said top wall so as to reside within said hollow interior of said housing, said receptacle defines an open, upper end opposing a closed bottom end, said receptacle defines a diameter having a measure being sufficient to accommodate standard-sized, commercially-available disposable or nondisposable plates.

8. The food and beverage article dispenser of claim 7, wherein said receptacle includes a circular pressure head slidably disposed therein, said circular pressure head includes a downwardly-depending apron extending peripherally thereabout, said circular pressure head is spring-urged in an upward direction of said receptacle by a spring which is coupled between an underside of said circular pressure head and said closed bottom end of said receptacle, said spring is defined as resilient, said spring is adapted to compress when a stack of plates are supported atop said circular pressure head, and said spring is adapted to resiliently bias said circular pressure head upwardly as each plate of the stack of plates is successively withdrawn, said plate dispenser assembly is adapted to functionally accommodate and dispense disposable or nondisposable plates.

9. The food and beverage article dispenser of claim 1, further comprising:

a pair of inwardly-collapsible, paper towel roll holders, said pair of inward-collapsible, paper towel roll holders are mounted in spaced relation to a front sidewall of said upstanding sidewall, said pair of inward-collapsible paper towel roll holders is adapted to support a standard commercially-available paper towel roll.

10. The food and beverage article dispenser of claim 1, further comprising:

a utensil organizer, said utensil organizer is hingedly attached to a right sidewall of said upstanding sidewall via a bracket assembly.

11. The food and beverage article dispenser of claim 1, further comprising:

a collapsible handle, said collapsible handle is horizontally mounted to a rear sidewall of said upstanding sidewall, said collapsible handle includes two elongated legs adapted to retract within said hollow interior of said housing.

12. The food and beverage article dispenser of claim 1, further comprising:

a storage drawer, said storage drawer is adapted to slidably engage and mate with an elongated opening defined through a left sidewall of said upstanding sidewall; and a dispenser cover, said dispenser cover is adapted for superimposition over said top wall of said housing, said dispenser cover defines a shape which closely corresponds to or matches a shape defining said top wall of said housing.

13. The food and beverage article dispenser of claim 1, wherein said upstanding sidewall of said housing defines a rear sidewall to which a pair of surface-mounting brackets are integrally molded thereto in spaced relation, wherein each of said pair of surface-mounting brackets is provided with at least one aperture through which a fastener is inserted and screwed into a surface suitable for supporting said housing, and wherein each of said pair of surface-mounting brackets has a lower end which includes a pliable abutment member being outwardly disposed therefrom.

14. The food and beverage article dispenser of claim 10, wherein said utensil organizer is adapted to fold outwardly away from said right sidewall to an inclined position at which said utensil organizer is held thereat or prevented from further inclination via said bracket assembly, said utensil organizer is adapted to fold upward toward said right sidewall, against which said utensil organizer is detachably fastened via a friction-fit means, said utensil organizer is provided with a plurality of individual compartments for storing selected utensils, and a retaining net is affixed atop said individual compartments in order to retain the selected utensils therein, and wherein said utensil organizer includes a handle mounted to a front, outer sidewall thereof.

15. The food and beverage article dispenser of claim 12, wherein said elongated opening is defined between a pair of integrally-formed, opposing, inner sidewalls, said opposing, inner sidewalls are perpendicularly-oriented with respect to said left sidewall of said upstanding sidewall, said elongated opening provides entry into a drawer receiving cavity which is adapted to slidably receive said storage drawer via a track assembly, said storage drawer defines an arcuate-shaped, front wall opposing a horizontally-oriented rear wall and two opposing vertically-oriented sidewalls, said storage drawer further defines a bottom wall opposing an open top which provides entry into an article storage cavity.

16. The food and beverage article dispenser of claim 12, wherein a track assembly comprises a ridge segment being integrally-formed and extending longitudinally down each of said opposing, inner sidewalls, each said ridge segment is adapted to mate respectively with an elongated channel formed in each of said opposing vertically-oriented sidewalls of said storage drawer.

17. The food and beverage article dispenser of claim 16, wherein said arcuate-shaped, front wall of said storage drawer is transparent, and wherein said arcuate-shaped, front wall has a handle mounted thereto.

18. The food and beverage article dispenser of claim 1, wherein said top wall and said bottom wall of said housing have a front edge which defines a first narrow lobe portion and a second narrow lobe portion, wherein said first narrow lobe portion and said second narrow lobe portion each define a longitudinal configuration, and said first narrow lobe portion and said second narrow lobe portion flank a wide, middle portion to which a pair of inwardly-collapsible, paper towel roll holders are mounted.

19. The food and beverage article dispenser of claim 1, wherein said top wall and said bottom wall of said housing have a rear edge which defines a third narrow lobe portion and a fourth narrow lobe portion, wherein said third narrow lobe portion and said fourth narrow lobe portion each define a longitudinal configuration adapted to correspond aesthetically with said first narrow lobe portion and said second narrow lobe portion, a first narrow lobe portion, a second narrow lobe portion, said third narrow lobe portion, and said fourth narrow lobe portion define comers of said housing.

20. The food and beverage article dispenser of claim 1, wherein said housing defines a generally square configuration.

* * * * *